US008377568B2

(12) United States Patent
Chang et al.

(10) Patent No.: US 8,377,568 B2
(45) Date of Patent: Feb. 19, 2013

(54) COATED ARTICLE

(75) Inventors: Hsin-Pei Chang, Tu-Cheng (TW); Wen-Rong Chen, Tu-Cheng (TW); Huann-Wu Chiang, Tu-Cheng (TW); Cheng-Shi Chen, Tu-Cheng (TW); Jia Huang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/154,589

(22) Filed: Jun. 7, 2011

(65) Prior Publication Data

US 2012/0064368 A1 Mar. 15, 2012

(30) Foreign Application Priority Data

Sep. 15, 2010 (CN) ..... 2010 1 0282317

(51) Int. Cl.
*B32B 15/04* (2006.01)
*B32B 18/00* (2006.01)

(52) U.S. Cl. ..... 428/633; 428/660; 428/680; 428/336; 428/630; 428/215

(58) Field of Classification Search ..... 428/632, 428/633, 639, 660, 661, 680, 213, 215, 216, 428/220, 332, 336, 630, 631
See application file for complete search history.

(56) References Cited

U.S. PATENT DOCUMENTS 4,559,124 A * 12/1985 Divisek et al. ..... 204/295
6,379,845 B1 * 4/2002 Inazawa et al. ..... 429/235

* cited by examiner

*Primary Examiner* — Michael La Villa
(74) *Attorney, Agent, or Firm* — Altis Law Group, Inc.

(57) ABSTRACT

A coated article includes a substrate, a catalyst layer and a self-cleaning layer. The catalyst layer made of nickel is formed on the substrate. The self-cleaning layer is formed on the catalyst layer, including titanium, nickel, nickel oxide and titanium dioxide.

3 Claims, 2 Drawing Sheets

COATED ARTICLE

BACKGROUND

CROSS-REFERENCE TO RELATED APPLICATION

This application is related to U.S. patent application Ser. No. 13/170,910, pending, entitled "COATED ARTICLE AND METHOD OF MAKING THE SAME". Such application has the same assignee as the present application. The above-identified application is incorporated herein by reference.

TECHNICAL FIELD

This disclosure relates to coated article, particularly, to a coated article with a self-cleaning layer and a method of making the same.

Titanium oxide is a typical photocatalysis material, which can oxygenolysis dust and contaminant thereon. That is to say, titanium oxide has self-cleaning function. Mixing metal or non metal into titanium oxide is a conventional method to improve the photocatalytic activity of the titanium oxide. However, the process of this method is complex and costly.

Therefore, there is room for improvement within the art.

BRIEF DESCRIPTION OF THE DRAWINGS

Many aspects of the coated article and method of making the same can be better understood with reference to the following drawings. The components in the drawings are not necessarily drawn to scale, the emphasis instead being placed upon clearly illustrating the principles of the coated article and method of making the same.

DETAILED DESCRIPTION

Figure 1:
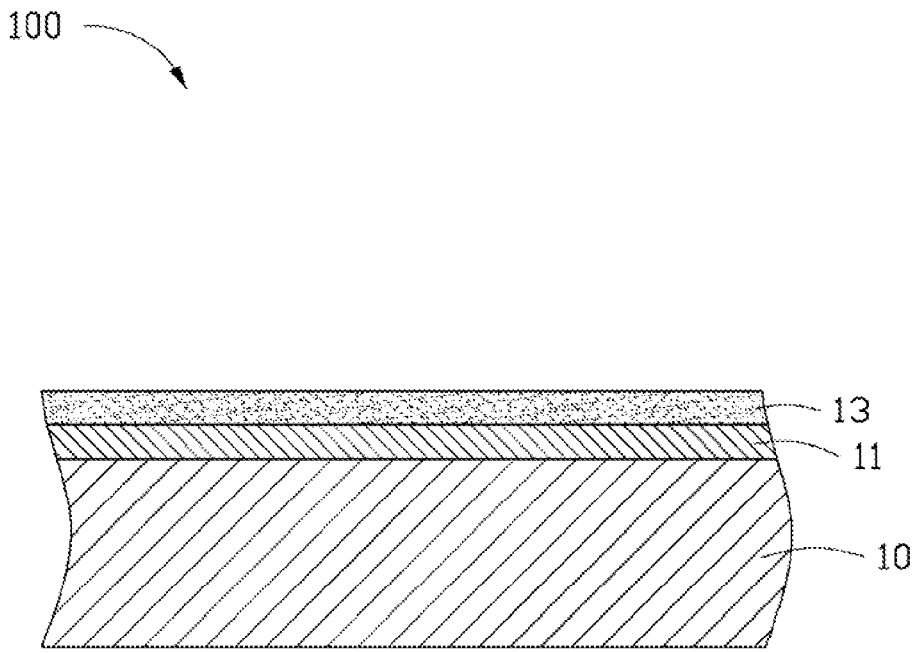
FIG. 1 is a schematic view of a coated article, in accordance with an exemplary embodiment.

FIG. 1 shows an exemplary embodiment of a coated article 100. The coated article 100 includes a catalyst layer 11 and a self-cleaning layer 13 formed on a substrate 10 in that order. Each of the layers 11, 13 has a thickness in a range of 0.5 μm to 1.0 μm.

The substrate 10 may be made of metal, e.g., stainless steel, aluminum, or non-metal, e.g., ceramics, glass. The catalyst layer 11 is made of nickel. The self-cleaning layer 13 includes titanium, nickel, nickel oxide and titanium dioxide.

Figure 2:
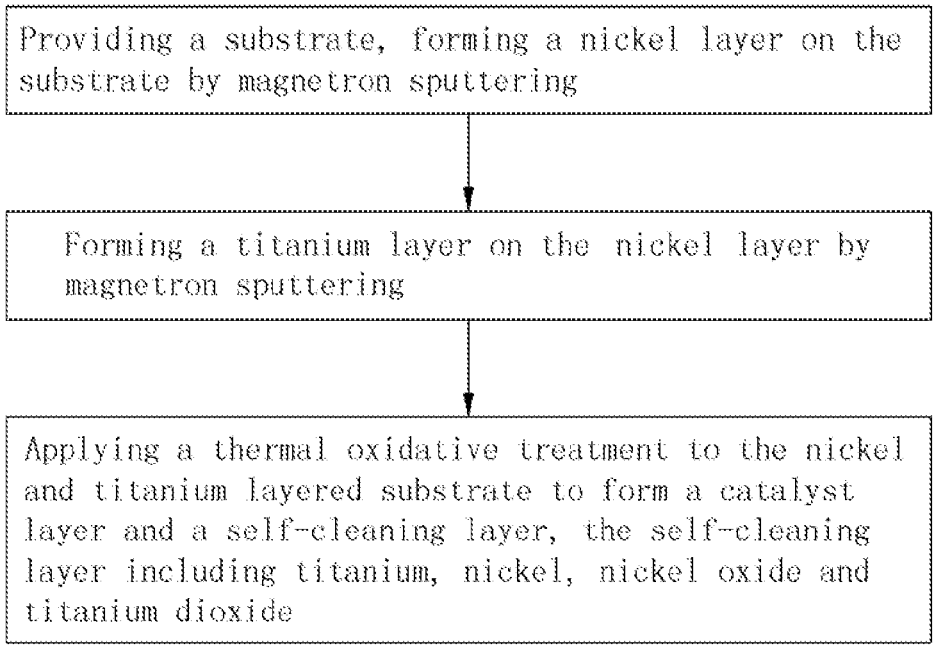
FIG. 2 is a flow schematic view of making the coated article shown in FIG. 1.

Referring to FIG. 2, a method of making the coated article 100 includes the following steps:

A substrate 10 is provided. The substrate 10 may be a metal, e.g., stainless steel, aluminum, or a non-metal, e.g., ceramics, glass.

A surface pre-treatment is applied to the substrate 10. The pre-treatment includes oil cleaning by chemical method, paraffin removal, acid cleaning, cleaning by ultrasound and drying.

The substrate 10 is cleaned by plasma. This process can further remove the oil on the substrate 10, which can increase a bonding force between the substrate 10 and the following layer formed on the substrate 10. In this process, the substrate 10 is set in a vacuum chamber (not shown) of a vacuum sputtering coating machine (not shown). Air in the vacuum chamber is pumped out until the pressure in the vacuum chamber is about $8*10^{-3}$ pascals (Pa). Argon gas is input to the chamber at a flow rate in a range of 50 sccm to 400 sccm. The purity of the argon gas is 99.9999%. A bias voltage in a range of −300V to −600V is applied to the substrate 10, and the substrate 10 is then cleaned with plasma. The time of this cleaning process is in a range of 5 minutes (min) to 10 min A nickel layer is formed on the substrate 10 by magnetron sputtering. A nickel target is placed in the vacuum chamber and is electrically connected to a power source. A pressure in the vacuum chamber is in a range of $4*10^{-3}$ Pa to $5.3*10^{-3}$ Pa. Argon gas as a working gas is input to the chamber at a flow rate in a range of 300 sccm to 500 sccm. The power source connected to the nickel target is activated and a bias voltage in a range of −100V to −200V is applied to the nickel target. A nickel layer is deposited on the surfaces of the substrate 10. The nickel layer is at a temperature in a range of 50° C. to 100° C. The time of this depositing process is in a range of 5 min to 10 min. The power source connected to the nickel target is closed after the depositing process.

A titanium layer is formed on the nickel layer by magnetron sputtering. A titanium target is provided in the vacuum chamber and is connected to a power source. A pressure in the vacuum chamber is about $4*10^{-3}$ Pa to $5.3*10^{-3}$ Pa. Argon gas is input to the chamber at a flow rate in a range of 300 sccm to 500 sccm. The power source connected to the titanium target is activated and a bias voltage in a range of −150V to −200V is applied to the titanium target. The titanium layer is deposited on the nickel layer. The temperature of the titanium layer is about 120° C. to 200° C. The time of this depositing process is in a range of 5 min to 10 min. The power source connected to the titanium target is closed after the depositing process.

A thermal oxidative treatment is applied to the nickel and titanium layered substrate. In this process, the layered substrate 10 is placed in an air chamber containing less than 2% oxygen by volume but greater than 0%. The layered substrate 10 is heated to a temperature of about 400° C. to 700° C. at a speed of about 15° C./min to 30° C./min, and the temperature is maintained for 40 min to 90 min. The nickel of the nickel layer and the titanium of the titanium layer partially oxidize, which form the self-cleaning layer 13 including titanium, nickel, nickel oxide and titanium dioxide. The portion of the nickel layer without oxidation forms the catalyst layer 11.

The principle of forming the self-cleaning layer 13 is described as follows. The melting point of nickel is lower than titanium. During the oxidation process, the oxygen molecules penetrate the titanium layer via the interstices of the titanium atoms and act with the nickel atoms to form nickel oxide. The nickel oxide forms nanoneedle or nanorod structures, promoting oxidation of the titanium in the titanium layer.

The self-cleaning layer 13 formed by the above method has a micron-nano mastoid structure on the substrate 10, which increases surface area of the self-cleaning layer 13. This improves the photocatalytic activity of the self-cleaning layer 13 and the article coated with the self-cleaning layer 13 has a good self-cleaning function.

It is to be understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A coated article, comprising:

a substrate;

a catalyst layer made of metallic nickel and formed on the substrate;

a self-cleaning layer formed on the catalyst layer, the self-cleaning layer including, metallic titanium, metallic nickel, nickel oxide and titanium dioxide.

2. The coated article as claimed in claim 1, wherein each of the catalyst layer and the self-cleaning layer has a thickness of about 0.5 μm to about 1.0 μm.

3. The coated article as claimed in claim 1, wherein the substrate is made of a material selected from the group consisting of metal, ceramic and glass.

* * * * *